United States Patent [19]

Stiebellehner et al.

[11] 4,432,811

[45] Feb. 21, 1984

[54] METHOD OF MAKING SEAMLESS TUBING

[75] Inventors: Johann Stiebellehner, Pottschach; Peter Machner, Leoben, both of Austria

[73] Assignee: Vereinigte Edelstahlwerke Aktiengesellschaft, Vienna, Austria

[21] Appl. No.: 432,762

[22] Filed: Oct. 4, 1982

[30] Foreign Application Priority Data

Oct. 8, 1981 [AT] Austria ..... 4313-81

[51] Int. Cl.[3] ..... C21D 8/00

[52] U.S. Cl. ..... 148/2; 148/12 E; 148/136

[58] Field of Search ..... 148/2, 12 E, 12 R, 38, 148/136; 164/147.1, 511; 29/527.6; 72/368

[56] References Cited

U.S. PATENT DOCUMENTS 3,523,833 8/1970 Kroneis et al. ..... 148/12 R

FOREIGN PATENT DOCUMENTS 528354 7/1956 Canada ..... 164/147.1

*Primary Examiner*—L. Dewayne Rutledge
*Assistant Examiner*—Robert L. McDowell
*Attorney, Agent, or Firm*—Brumbaugh, Graves, Donohue & Raymond

[57] ABSTRACT

A process for producing seamless tubes of austenitic steels is disclosed. A metallic melt is continuously poured into a cooled mold having a round molding cavity. The as yet fully unsolidified extracted billet is electromagnetically agitated in a direction about its longitudinal axis. Once hardened, the billet is cross cut, and the castings are subjected to annealing at a temperature between 1100° C. and 1250° C. (preferably between 1150° C. and 1200° C.) for between 30 minutes and 4 hours (preferably between 1 hour and 2 hours). The castings are allowed to cool, are machined into extrusion blooms and the seamless tubes produced by extrusion of the blooms.

6 Claims, No Drawings

METHOD OF MAKING SEAMLESS TUBING

BACKGROUND OF THE INVENTION

The invention relates to a process for producing seamless tubes of austenitic steels containing chromium and nickel.

Austenitic tubes may be made by a crossrolling process, by extrusion, by continuous casting or by welding of sheet-metal strips. While it is true that welded tubes are less costly to manufacture, because of the welding seam which results they have a relatively small range of applications. In the crossrolling process a mandrel must be driven through a corresponding bloom, and efficient application is obtained only in certain cross sections.

In the manufacture of seamless tubes by extrusion, a heated steel is forced through a die, where very intense deformations occur. For austenitic tube quality, it has been necessary for the steel to undergo a corresponding deformation before being subjected to extrusion, in order to obtain a corresponding change in structure and an improvement in ductility.

It is known that steels having a high chromium and nickel content may be processed by continuous casting into seamless tubes of any desired length. An overheated mass of molten steel is fed continuously into a mold which is rotating about its axis. The molten steel is pressed against the mold by centrifugal force and, when delivery of the metallic melt is appropriately limited, an axially symmetrical cavity may be obtained. However, this process permits only tubes having a relatively great diameter to be produced, and the mechanical and metallurgical properties of the resulting tubes are not satisfactory.

SUMMARY OF THE INVENTION

The object of the present invention is to provide a process for producing seamless tubes of an austenitic chromium nickel alloy in which the above-mentioned disadvantages are avoided, while obtaining the advantages of continuous casting combined with those of extrusion.

According to the process pursuant to the invention, a metallic melt is poured continuously into a cooled mold having a round molding cavity, and is allowed to solidify partially in the latter. The as yet unsolidified metallic melt is electromagnetically agitated in a direction about the longitudinal axis of the billet, and once extracted and thoroughly hardened, is cut into lengths. The crosscut continuous castings are subjected to annealing between 1100° C. and 1250° C. (preferably between 1150° C. and 1200° C.) for between 30 minutes and 4 hours (preferably for between 1 hour and 2 hours). The continuous castings are allowed to cool, and are mechanically reduced by machining to extrusion blooms, whereupon seamless tubes are produced, in a manner known per se, from the extrusion blooms as cast and not yet subjected to any hot-working.

Immediately treating austenitic steel which has been processed in the continuous casting process, for the production of seamless tubes by the extrusion process, has hitherto not been done. The dendrites oriented toward the center of the billet and the radiating coarse-grained solidification structure have proved to have particularly detrimental consequences for treatment. At the same time, preferential enrichment of impurities and also porosities have appeared in the center of the billet. Due to the unevenness of the porosities in the interior of the billet, an accurately centered hole is not ordinarily obtained, and non-uniform tube-wall thicknesses result.

The orientation of the dendrites, the coarse grain structure and microsegregations have led to inadequate hot-workability of the bloom, so that cracks or brittleness have appeared in the extruded tube blank. The inventors have now found, very surprisingly, that by combining electromagnetic agitation of the melt about the axis of the billet and subsequent thermal treatment of the billet pieces, entirely satisfactory results may be obtained without any hot-working before extrusion.

By agitating the as yet unsolidified metallic melt in a direction about the longitudinal axis of the billet, on the one hand homogenization of the alloy in the billet is obtained and, on the other hand, centrad orientation of the dendrites is avoided. In addition, a fine-grained structure and fine and uniform distribution of precipitated phases, delta ferrite in particular, is obtained through fairly small microsegregations. Most of this fine-grained delta ferrite now present may be dissolved by the ensuing annealing treatment. An extrusion bloom having a small content of delta ferrite may therefore be obtained, so that appropriate great deformation, as must be accomplished in extrusion, may take place. This result is the more surprising as it must be considered that the delta ferrite content in the steel may per se be substantially increased by annealings at rather high temperatures.

Owing to the fine-grained structure of the extrusion bloom, a particularly uniform and outstanding surface quality of the tube, making it easy to finish, is obtained.

According to another feature of the invention, the metallic melt is moved, at least in a part of the mold, about the longitudinal axis of the billet, the relative motion between billet shell and liquid core of the billet extending to the casting surface. This procedure results in the desired dendritic configuration and a fine-grained structure extending to the surface of the billet, making a higher yield attainable in the preparation of blooms.

If the continuous castings, with a minimum temperature of approximately 700° C. at their surface, are subjected to annealing immediately after continuous casting, this results in a fairly small precipitation of carbides, for example, chromium carbides, taking place at the grain boundaries, while at the same time no conversion of delta ferrite into the sigma phase takes place, whereby longer annealing would be required.

An especially advantageous labor-saving process is obtained when mechanical treatment of the continuous castings by machining to an extrusion bloom is performed before annealing. In this procedure mechanical treatment by machining is especially easy to accomplish because fairly little material ductility exists before annealing.

If from the annealing heat the extrusion bloom as cast is subjected to extrusion, an additional manipulation is omitted and, at the same time, the energy for renewed heating need not be consumed.

DETAILED DESCRIPTION OF THE EXEMPLARY EMBODIMENT

The invention is explained in greater detail below by means of the following examples.

EXAMPLE 1

A steel X10CrNiTi 18 9 was melted in a medium frequency coreless induction furnace, tapped into a ladle and taken to a continuous-casting unit. From this ladle the alloy was poured into the distributor of the continuous-casting unit, overheating of the metal being 35° C. From the distributor the steel was introduced, by means of a pouring tube, into the continuous casting mold with an inside diameter of 210 mm, and after a startup stage of 0.3 minute, a casting speed of 1.05 m./min. was attained. Casting was effected with a covered casting surface, i.e., under powder.

A three-pole rotating field system was mounted in the unit 220 mm below the lower edge of the 650 mm-long mold. During casting the rotating field was suppled with an input of 72 kVA. On the basis of observations of the casting surface or the casting powder at the casting head, it was determined that the liquid billet performed a rotating motion about the longitudinal axis of the billet, up to the casting surface in the mold.

After cooling of the billet, a test piece was taken from it for further studies. The billet pieces were annealed in a furnace at 1190° C., for a holding time of 1.6 hours. After the annealing treatment a test piece was again taken from the billet. Comparative tests revealed that after continuous casting a delta ferrite content of 4.6% was present in the material. Such high delta ferrite contents have an extremely detrimental effect on the ductility of the material. After annealing the delta ferrite content in the billet amounted to under 1%.

Treatment of the surface of the continuous casting, sawing and boring were followed by inductive heating of the extrusion bloom and expansion by means of expanding cap and mandrel. The expansion process proceeded without any problem, i.e., the material exhibited good hot-working properties. Following expansion of the bloom, after intermediate heating, the extrusion process took place (per Handbook of Stainless Steels, McGraw Hill Book Co., 1977, Chapter 23). The extruded blank tube exhibited a good surface, both inside and out. No difficulties were encountered in subsequent treatment either, because the material had good ductility.

The quality of the tube was also examined by graduated torsional tests. It was demonstrated that no disturbing elongated non-metallic inclusions were present in the tube wall, i.e., that the tube exhibited especially high-quality features.

EXAMPLE 2

A procedure similar to that of Example 1 was followed, a compound tube mold with integrated agitator spool being used, and a steel X5CrNi 18 9 being run in. Overheating of the melt amounted to 25° C. After a startup stage of 0.4 minute, casting speed was 1.0 m./min. The rotating field power input to the electromagnetic agitator was 65 kVA. Annealing was performed, after cooling of the billet, at 1150° C. for 2.8 hours. The delta ferrite content before annealing amounted to 4.8%, and after annealing was under 1%. No difficulties of any kind appeared in the extrusion process, and the extruded tube exhibited a good surface both inside and out.

EXAMPLE 3

A steel X2CrNiMo 18 10 was treated in a manner similar to that of Example 1. Overheating of the melt was 30° C. and, after a startup stage of 0.3 minute, a casting speed of 1.1 m./min. was maintained. The rotating field power input to the electromagnetic agitating device was 72 kVA. Immediately after continuous casting, the castings were transferred to a furnace at a billet surface temperature of 715° C. and subjected to annealing at 1200° C. for 1.4 hours. The delta ferrite content was under 1%. The continuous casting, reduced mechanically by machining to an extrusion bloom, was then subjected to the extrusion process according to Example 1. The tube obtained exhibited no surface defects of any kind, and the extrusion process proceeding without incident.

EXAMPLE 4

A steel X10CrNiNb 18 9 was treated in a manner similar to that of Example 1. Mechanical reduction of the continuous casting by machining to an extrusion bloom was performed before annealing. The mechanical treatment was lighter than in the preceding example, as brittle chips were present. The continuous casting bloom was then heated to 1190° C. in the rotary-hearth furnace and held at this temperature for 2 hours. Immediately out of the annealing heat the extrusion process was carried out, no difficulties being observed in the processing by extrusion and the blank tube exhibiting a good surface, both inside and out.

We claim:

1. In a process for producing seamless tubes of austenitic chromium-nickel steels by continuous casting, wherein a metallic melt is poured continuously into a cooled mold having a round molding cavity, said melt being allowed to solidify partially in said cavity, and wherein a billet is extracted from said mold and cut into crosscut lengths after thoroughly hardening, the improvement comprising electromagnetically agitating said billet in a direction about its longitudinal axis prior to complete hardening, when said billet comprises a billet shell and a liquid billet core, annealing said crosscut continuous castings at a temperature of from 1100° C. to 1250° C. for a holding time between 30 minutes and 4 hours, cooling said casting and thereafter mechanically reducing said castings to extrusion blooms by machining, and extruding said blooms, without hot-working said blooms, to produce said seamless tubes.

2. A process for producing seamless tubes according to claim 1, further comprising moving said metallic melt at least in a portion of said mold about the longitudinal axis of said billet while the relative motion between said billet shell and said liquid billet core extends as far as the casting surface in said mold.

3. A process for producing seamless tubes according to claims 1 or 2, further comprising annealing said continuous castings at a minimum temperature of approximately 700° C. at their surface immediately after casting.

4. A process for producing seamless tubes according to claims 1 or 2, further comprising mechanical reducing said billets into said extrusion blooms prior to annealing.

5. A process for producing seamless tubes according to claim 4, further comprising extruding said extrusion bloom as cast immediately from the annealing heat.

6. A process for producing seamless tubes in accordance with any of claims 1, 2, 4 or 5, wherein said annealing temperature is from 1150° C. to 1200° C., and said holding time is between 1 hour and 2 hours.

* * * * *